United States Patent [19]

Lumelsky

[11] Patent Number: 4,816,814

[45] Date of Patent: Mar. 28, 1989

[54] VECTOR GENERATOR WITH DIRECTION INDEPENDENT DRAWING SPEED FOR ALL-POINT-ADDRESSABLE RASTER DISPLAYS

[75] Inventor: Leon Lumelsky, Stamford, Conn.

[73] Assignee: International Business Machines Corporation, Armonk, N.Y.

[21] Appl. No.: 13,848

[22] Filed: Feb. 12, 1987

[51] Int. Cl.[4] ..... G09G 1/16

[52] U.S. Cl. ..... 340/747; 340/723; 340/727; 340/744

[58] Field of Search ..... 340/723, 727, 732, 744, 340/747, 750; 364/518, 521, 719

[56] References Cited

U.S. PATENT DOCUMENTS

| | | | |
|---|---|---|---|
| 3,675,232 | 7/1972 | Strout | 340/324 A |
| 3,906,480 | 2/1973 | Schwartz et al. | 340/324 AD |
| 4,272,808 | 6/1981 | Hartwig | 364/719 |
| 4,458,330 | 7/1984 | Imsand et al. | 340/747 |
| 4,529,978 | 7/1985 | Rupp | 340/727 |
| 4,555,775 | 11/1985 | Pike | 364/900 |
| 4,580,236 | 4/1986 | Tsujioka et al. | 364/521 |
| 4,593,407 | 6/1986 | Konishi et al. | 340/727 |
| 4,623,880 | 11/1986 | Bresenham et al. | 340/747 |
| 4,642,625 | 2/1987 | Tsunehiro et al. | 340/747 |
| 4,644,503 | 2/1987 | Bantz et al. | 364/521 |
| 4,701,752 | 10/1987 | Wang | 340/727 |
| 4,706,205 | 11/1987 | Akai et al. | 340/727 |

OTHER PUBLICATIONS

J. D. Foley and A. Van Dam, "Fundamentals of Interactive Computer Graphics", Addison—Wesley Publishing Co., 1982, pp. 433–436.

R. F. Sproull, I. E. Sutherland, A. Thompson, S. Gupta and C. Minter, "The 8 by 8 Display", Technical Report, California Institute of Technology and Carnegie—Mellon University, Dec. 1981, pp. 9–11.

*Primary Examiner*—Gerald L. Brigance
*Assistant Examiner*—Jeffery A. Brier
*Attorney, Agent, or Firm*—Roy R. Schlemmer, Jr.

[57] ABSTRACT

A vector generator for us with an all-points-addressable frame buffer capable of the non-word aligned access, simultaneously, of a square M by N array of pixels providing fast vector drawing independently of vector slope and position in the whole screen area of an attached display monitor. The vector generator utilizes a triangular logic matrix together with a line drawing unit to generate M vector bits lying in an M by N square matrix of the screen of an attached monitor in one memory cycle of the frame buffer and uses the generated matrix to generate a direct mask for the frame buffer whereby the M bit vector may be stored in a single memory cycle.

12 Claims, 13 Drawing Sheets

BIT LOCATIONS IN MATRIX

BIT MAPPINGS BEFORE / AFTER TRANSFORMATION

DIR=0, SL=0

| | | | |
|---|---|---|---|
| 12 | 13 | 14 | 15 |
| 8 | 9 | 10 | 11 |
| 4 | 5 | 6 | 7 |
| 0 | 1 | 2 | 3 |

DIR=0, SL=1

| | | | |
|---|---|---|---|
| 3 | 7 | 11 | 15 |
| 2 | 6 | 10 | 14 |
| 1 | 5 | 9 | 13 |
| 0 | 4 | 8 | 12 |

B = T(A)

DIR=1, SL=0

| | | | |
|---|---|---|---|
| 0 | 1 | 2 | 3 |
| 4 | 5 | 6 | 7 |
| 8 | 9 | 10 | 11 |
| 12 | 13 | 14 | 15 |

C = M(A)

DIR=1, SL=1

| | | | |
|---|---|---|---|
| 0 | 4 | 8 | 12 |
| 1 | 5 | 9 | 13 |
| 2 | 6 | 10 | 14 |
| 3 | 7 | 11 | 15 |

D = M(B) = MT(A)

MUX 1
MUX 2
MUX 3
MUX 4
VM(0..3)
VM(4..7)
VM(8..11)
VM(12..15)
Q:
EOV
DIR
SL

VECTOR GENERATOR WITH DIRECTION INDEPENDENT DRAWING SPEED FOR ALL-POINT-ADDRESSABLE RASTER DISPLAYS

CROSS REFERENCE TO RELATED COPENDING APPLICATIONS

U.S. patent application Ser. No. 7/013,842 (KI9-86-029) entitled "A HIGH RESOLUTION GRAPHICS DISPLAY ADAPTER" filed Feb. 12, 1987 relates to an overall high function video display adapter in which the architecture of the present invention has particular utility.

U.S. patent application Ser. No. 7/013,843 (YO986-105) filed Feb. 12, 1987 entitled "A FRAME BUFFER CAPABLE OF ACCESSING ALIGNED SQUARE WORDS OF THE SCREEN" discloses a frame buffer architecture which permits a substantial increase in the speed of a number of display operations as well as enhancing the versatility of the adapter in terms of the functions that may be performed off line. The hardware of this application would be located in the "frame buffer" block of application Ser. No. 7/013,842 (KI9-86-029).

U.S. patent application Ser. No. 7/013,841 (AT9-86-070) filed Feb. 12, 1987 entitled "A GRAPHICS DISPLAY SYSTEM FUNCTION CIRCUIT" discloses a graphics function address counter circuit similar to that set forth herein which is uniquely suited to the overall video display adapter architecture set forth in the above referenced application Ser. No. 7/013,842 (KI9-86-029).

U.S. patent application Ser. No. 7/013,847 (YO9-86-104) filed Feb. 12, 1987 entitled "PIXEL DATA PATH FOR HIGH PERFORMANCE RASTER DISPLAYS WITH ALL-POINT ADDRESSABLE FRAME BUFFERS" discloses a channel architecture which could be utilized in the pixel data path feeding the frame buffer of such an adapter and which enables a number of versatile pixel data operations within the frame buffer. The hardware of this application would be located within "pixel processor" block of Application Ser. No. 7/013,842 (KI9-86-029).

U.S. patent application Ser. No. 7/013,840 (Docket No. AT9-86-072) filed Feb. 12, 1987 entitled "A GRAPHICS DISPLAY SYSTEM WITH MEMORY ARRAY ACCESS" discloses circuitry for performing functions in the "pixel processor" block of application Ser. No. 7/013,842 (KI9-86-029). This application specifically relates to circuitry for controlling pixel data provided to the frame buffer of the video adapter and includes controllable write mask used in storing pixel data in the associated frame buffer.

U.S. patent application Ser. No. 7/013,849 (Docket No. AT9-86-073) filed Feb. 12, 1987 entitled "A GRAPHICS FUNCTION CONTROLLER FOR A HIGH PERFORMANCE VIDEO DISPLAY SYSTEM" discloses circuitry for performing line drawing and bit block transfer operations in the pixel processor block of application Ser. No. 7/013,842 (Docket No. KI9-86-029).

FIELD OF THE INVENTION

The present invention relates generally to the field of display adapters for interfacing between a computer and an attached raster scan video display monitor. It relates more specifically to such an adapter which provides many functions previously unavailable to small micro and mini systems in stand along workstations.

The invention relates still more specifically to a vector generator and its associated control circuitry uniquely adapted for use in such a display adapter.

BACKGROUND OF THE INVENTION

As the speed and file capacity of work stations in personal computers increases, the demand for high resolution intelligent display adapters also increases. Large graphic applications formerly limited to mainframe computers having dedicated graphic display terminals can use this increased capability in the adapters to migrate their graphic applications to stand alone systems. The present invention describes functions that can be incorporated into a video display adapter to provide, in stand alone work stations, the graphic functions and performance required by such complex graphic applications.

Such increased capability display adapters are especially needed for such small stand alone systems as the IBM PC/AT and the IBM RT-PC which can provide high-performance, moderate-cost adapter functions which cover a very broad spectrum of applications.

A primary requirement for a stand alone video adapter is the capability of generating vectors with a minimum of intervention by the host computer system. Vector drawing in raster displays usually provides satisfactory performance in just one direction of drawing, since the frame buffer architecture usually allows a parallel access to several pixels only along the horizontal axis.

Sloped vectors in such displays are conventionally drawn pixel wise. If a picture or display includes a large number of sloped vectors, which is the case in CAD/CAM computer graphics, the overall system performance is greatly degraded.

In order to increase performance, several other approaches have been used in the past.

The simplest way is to provide a parallel access to the frame buffer in two directions. It is an expensive, but efficient method, if the probability of using sloped vectors is small compared to horizontal and vertical lines.

Next, sloped vectors can include multipixel horizontal segments, especially if its slope to a preferable axis is small. Based on that fact, the frame buffer may be accessed in parallel or pixel wise, depending on whether a vector segment is parallel to a preferable axis, or not. Another solution is to use an extra small and fast cache memory in order to draw segments, and then copy the cache data into the frame buffer in page mode.

Advances in hardware design now make it possible to modify frame buffer addressing, depending on the vector slope, in order to provide parallel access to memory cells not positioned along the axis.

All of the above referenced approaches have significant disadvantages. The first two do not increase performance satisfactorily, e.g., for CAD/CAM systems. Also, the drawing time depends on the nature of the drawing itself, which is inconvenient in the case of geometric picture transformations, especially real time rotation. The last two methods require very complicated extra hardware.

Contemporary raster display architectures frequently include built-in hardware to boost performance and facilitate programming. In particular, the three most common features frequently used are:

built-in bit-blt address control, built-in vector generator, and all-points addressable (APA) frame buffer with two axes independent square access.

The first feature is quite convenient for area copy or modification, but does not add much to the vector drawing performance.

The built-in vector generator still cannot provide an equal performance independently of vector slope, although it helps to some extent by partially eliminating software codes.

The problem is even more complicated if known APA architectures are employed. This requires a complicated hardware manipulation of addresses and data, so the additional modification of hardware to boost the vector drawing performance is either too expensive or not practically achievable.

PRIOR ART

The following patents which were found during a prior art study of the present invention constitute the most relevant art known to the inventors in addition to the references discussed in the Background of The Invention Section.

U.S. Pat. No. 4,529,978 entitled "Method and Apparatus For Generating Graphic And Textual Images On A Raster Scan Display" concerns the drawing and transformation of characters (or a two-dimensional matrix) in raster scan displays. the main idea is to represent a character as a combination of short vectors or strokes ("outer vectors" in terms of the patent). Then, in order to modify a character width, slope, etc., the patent describes a way of calculating so-called "inner strokes", which represent the position and shape of a character in the frame buffer.

The patent is not concerned with high performance vector drawing in raster scan displays. In fact, the newly calculated "inner strokes" are written in a frame buffer pixel by pixel, (except when a stroke is horizontal). This approach does not provide good performance for vector drawing, although it may be sufficient for typing text on a screen.

In contrast to the patent, the present invention is concerned with high performance vector drawing, not with character transformations. Basically, it offers much higher performance for vector drawing, than the patent, because it makes possible the updating of several pixels in parallel independently of vector's origin and orientation.

The invention also shows a way of implementing stroke transformation, which is different from the patent, and is based on a parallel approach to matrix transformation such as vector alignment, slope and direction control. In contrast, the patent provides sequential (pixel-wise) transformation of matrix elements, although it is performed only for pixels which belong to the vector located inside the matrix. Obviously, the vector transformation, shown and described herein, is about N times faster, than the one described in the patent, where N is the longest linear dimension of a matrix.

U.S. Pat. No. 3,675,232 of Strout entitled "Video Generator For Display", and U.S. Pat. No. 3,906,480 of Schwartz et al entitled "Digital Television Display System Employing Coded Vector Graphics", describe image generation using a "character generator" approach. In contrast to the present invention, they do not concern themselves with bit-mapped graphics. The frame buffer stores codes of vector or character shapes. A character generator generates shapes of characters or vectors synchronously with horizontal scan and is a function of a character code and a video line number.

Essentially this approach does not require a large frame buffer, but uses instead a small, but fast memory for the character generator instead. Hence, the size and complexity of objects are greatly restricted. This is one significant reason, why the "character generator" approach is obsolete in comparison with bit-mapped graphics with which the present invention is concerned.

U.S. Pat. No. 4,555,775 of Pike entitled "Dynamic Generation And Overlaying Of Graphic Windows For Multiple Active Program Storage Areas", describes using a bit-blt graphics primitive for implementing the multiwindow environment for a raster display. It is not concerned with vector drawing.

SUMMARY AND OBJECTS

It is a primary object of the present invention to provide an enhanced vector generator architecture for use in a video adapter including an all-points-addressable frame buffer capable of accessing a pixel aligned M by N square array of pixels in said frame buffer.

It is a further object of the invention to provide such a vector generator which produces an M by N square array representation of the vector pixels simultaneously.

It is another object of the invention to provide such a vector generator architecture which utilizes a novel logic matrix to generate the desired pixel pattern within said M by N pixel array which represents the desired vector.

It is another object to provide such a vector generator architecture which utilizes certain of the addressing features of the bit-blt circuitry to facilitate the vector generation procedure to reduce the overall hardware requirements of the system.

It is another object of the invention to modify said bit-blt addressing features whereby the speed of address updating and thus vector generating is significantly enhanced.

The vector generator of the present invention is particularly adapted to be used with an all-points-addressable frame buffer capable of the non-word aligned access, simultaneously, of a square M by N array of pixels and provides fast vector drawing independently of vector slope and position in the whole screen area of an attached display monitor and is faster than using known methods and architectures. The vector shape is calculated under control of a fast clock, however, only short counters use this clock. Therefore, the implementation can be done in VLSI slow technology, e.g., CMOS. Only a small portion of the conventional vector generator hardware requires faster technology.

The vector generator utilizes a triangular logic matrix together with a line drawing used to generate M vector bits lying in an M by N square matrix of the screen of an attached monitor in one memory cycle of the frame buffer and uses the generated matrix to control a direct mask for the frame buffer whereby the M bit vector may be stored in a single memory cycle.

BRIEF DESCRIPTION OF THE DRAWINGS

FIG. 2A–3D illustrates the four possible sloped vector alignments which may be produced by a single vector generation and a translation generation.

DESCRIPTION OF THE PREFERRED EMBODIMENT

Before proceeding with a detailed description of the present vector generator and its associated control circuitry, a brief overview will be presented of a video adapter in which the present invention has particular utility. It is of course to be understood that the herein described video adapter is intended to be for illustration only and that the present invention could be used advantageously with other video adapter architectures as will be apparent to those skilled in the art.

Figure 1:
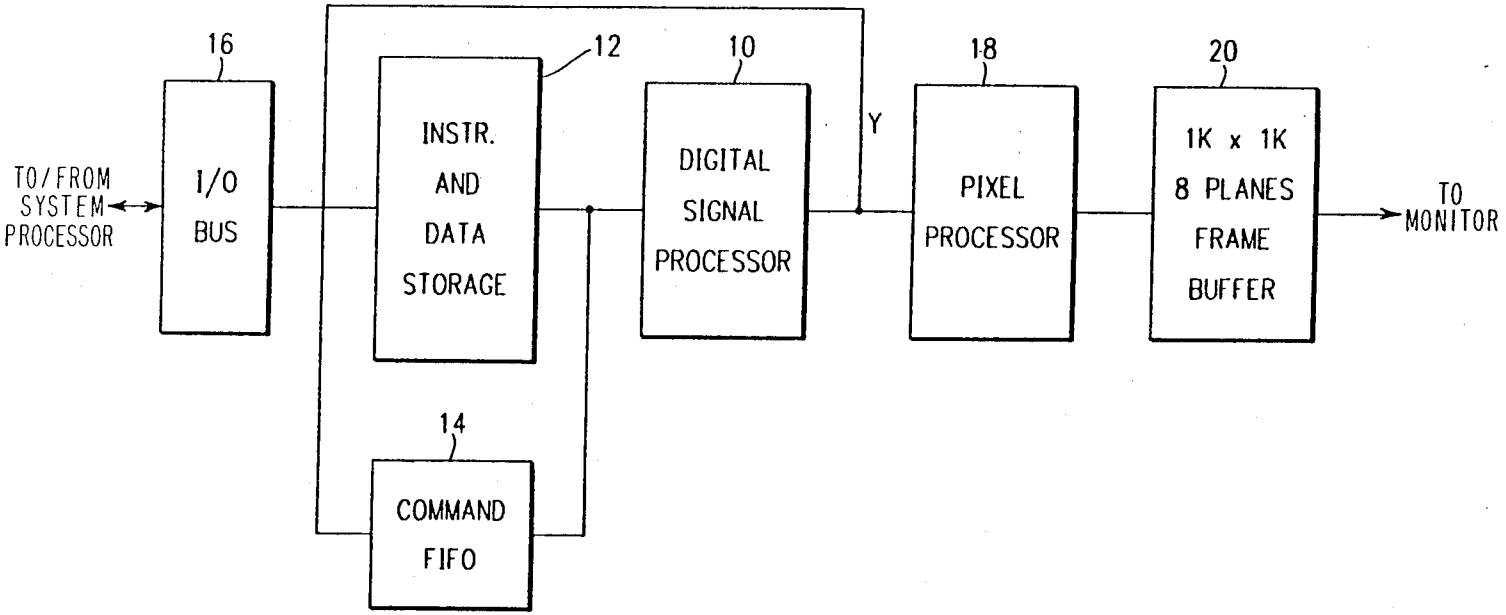
FIG. 1 comprises a high level functional block diagram of a video adapter in which the present invention has particular utility.

An overall functional block diagram of a video display adapter in which the present invention has particular utility is shown in FIG. 1.

The video display adapter is envisioned as a high resolution medium function graphics diaplay adapter which could drive any of a number of currently available display monitor units such as the IBM 5081. In a currently realizable form, it will support such a monitor with a resolution of 1024 by 1024 pixels and provides eight bits per pixel of video data information which provides 256 possible control features which may be distributed between color and/or gray scale data.

The following comprises a brief description of the overall function of the adapter, it being understood that for a more detailed description of such an adapter reference should be made to copending application Ser. No. 7/013,842 (KI9-86-029). Since the primary objective of the overall video display adapter is to provide advanced video display functions in a comparatively inexpensive adapter which is in turn adapted to be connected to processors or CPU's having somewhat limited processing capability, those functions which would otherwise be performable in a more sophisticated CPU are provided in the present adapter. Further, the functions are implementable via a relatively straightforward and simplified set of instructions.

Referring to FIG. 1, the overall adapter consists of the following major components. The digital signal processor 10 is utilized to manage the overall adapter's resources, it transforms display coordinates and performs a number of other fairly sophisticated signal processing tasks.

The instruction and data storage block 12 is an instruction RAM which can be loaded with additional micro code for the signal processor as will be understood. Block 12 also acts as a data RAM and provides the primary interface between signal processor 10 and the system processor. It also performs the function of being a main store for the signal processor 10.

Block 14 labeled command FIFO serves an an input buffer for passing sequential commands to the digital signal processor 10 via I/O bus 16, and is apparent, connects the video display adapter to the system or host processor.

The pixel processor 18 contains logic that performs a number of display supporting functions such as line drawing address manipulation which permits finite areas of the display screen to be manipulated (BIT BLT). A number of the novel aspects of the present display adapter are resident in the pixel processor block.

Block 20 labeled frame buffer comprises the video random access memory which feeds the monitor through appropriate digital analog conversion circuitry. As is apparent, the configuration herein disclosed has a resolution of approximately 1K by 1K pixels wherein each pixel represents a discrete element of video data to be displayed on the monitor which may contain as much information as is storable in the eight planes of the frame buffer which, as is well understood, means that there are eight bits of data per pixel. As will be further understood, these eight bits may be distributed among the red, green and blue of a color monitor or simply for intensity information in a gray scale black and white monitor.

The subject matter of the present invention is resident in the architecture of the pixel processor 18 and provides a number of functions relative to vector generation which permit the operation of the video adapter to be significantly speeded up as will be apparent from the subsequent description.

The objects of the present invention are accomplished by the herein described vector generator architecture which provides fast vector drawing independently of vector slope and location on the screen. The drawing performance is significantly faster compared with known methods.

The present vector generator architecture slightly modifies bit-blt control and adds a small amount of extra hardware for data mask manipulation. It provides statistically faster overall vector drawing performance than approaches mentioned previously under equal system timing conditions such as the memory access and cycle time. It also provides equal drawing speed in the whole screen area, independently of vector slope and ends coordinates and fully utilizes the contemporary raster display's hardware without degradation of its performance.

The approach in a sense resembles consecutive memory cycles in a bit-blt write-only mode but provides manipulations with the data mask and the bit-blt control parameters of vector drawing on the fly.

The vector generator (FIG. 2) performs a number of discrete functions. It calculates vector segments of equal length and uses each calculated segment as a mask during memory access. Finally it performs the calculations to modify bit-blt control parameters. By way of example, and in the preferred embodiment of the invention, a 4 by 4 pixel square access to the frame buffer is used.

Before proceeding with the description of the embodiment, the following list of definitions, functions, and in some cases the format of the more significant functional units and control signals is presented as a uniform reference source which will facilitate the understanding of the invention.

GLOSSARY OF TERMS

DIR Direction; "0"=up from origin; "1"=down from origin

SL Slope; "0" if equal or less than 45°
"1" if greater than 45°

EOV End of vector; "1"=last pixel is being generated

V CLOCK Vector clock; frame buffer Clock rate times 4

V MODE A single bit indicating a "vector" is being generated, not some other bit-blt operation D VAR Decision variable V LENR Vector length register—counts down as vector is generated, a "1" means the end of the vector has been reached VOR Vector orientation register SCNTR Source control unit MOPR Memory operation register SD Sign of decision variable; "−1"=go up, "0"=no change VCC A power supply voltage—Provides a logical "1" where necessary P1–P3 vector generator clock cycle pulses LDB1 Signals, loading data from the bus to the appropriate LDB2 counters (FIGS. 11, 12) before the start of vector drawing operation DCNTR Destination Control Unit SH An address incrementing pulse used in the X and Y address controls The vector generator (FIG. 2) includes a conventional vector generator, e.g., a Bresenham vector generator, vector matrix, vector orientation logic, Vector Orientation Register VOR and Vector Mode flip-flop VMODE. A suitable Bresenham vector generator is described in the book by J. D. Foley and A. Van Dam, "Fundamentals of Interactive Computer Graphics", Addison-Wesley Publishing Company, 1982, pages 433–436.

The Bresenham vector generator calculates vector X and Y deflections pixel wise, providing two outputs: EOV and SD. Signal EOV indicates the zero number in Vector Length Register VLENR, i.e., the end of vector drawing. Signal SD is the sign of a Decision Variable number, which is calculated sequentially for each pixel, starting from the beginning of the vector and continuing to the end of it, and showing whether the dependent coordinate should be incremented or not. There are an Adder (not shown) and two more registers holding two constant parameters INCR1R and INCR2R which are initially calculated and loaded into the Bresenham vector generator by methods described in the Foley et al book.

The Bresenham vector generator calculates EOV and SD four times during one memory access, because frame buffer Clock FBCLK which defines the memory access cycle is four times slower than the vector generator Clock VCLK serving the Bresenham vector generator. So each memory update cycle takes our VCLK periods.

The decision variable, vector length and the two additional parameters INCR1 and INCR 2 are calculated by the host processor as though the vector were being drawn in the first octant, and the starting point has a starting coordinate Xst which is less than the ending coordinate Xend. This means that the maximum of the two absolute results of the subtractions |Yend-Yst| and |Yend-Xst| is written into the VLENR register. It also causes the drawing process to always go in the same horizontal direction. Then the calculated parameters are loaded into the corresponding registers. Also, the real coordinates of the beginning of the vector are loaded into the frame buffer address registers.

The two control bits—vector slope SL and direction DIR—define the real octant in which the vector is drawn, if the beginning coordinates are placed in the starting point of the vector, i.e., first, second, seventh or eighth octanth (other octants are not used, because any vector can be considered to belong only to the class of octants described above). This is described more fully subsequently. Those control bits are loaded by the host processor into the VOR register and correspond to the possible vector positions as shown in FIGS. 3A–3D. If the Direction and Slope are (0,0) then vector is positioned in the first octant (see FIG. 3A), if the Direction and Slope are (0,1), then the vector is positioned in the second octant etc., if the Direction and Slope are (1,0) the vector is in the seventh octant, and if the Direction and Slope are (1,1) the vector is in the eighth octant.

The vector drawing starts after the VMODE flip-flop enables the VCLK which passes to the Bresenham vector generator hardware and stops after the EOV signal becomes true.

Figure 8:
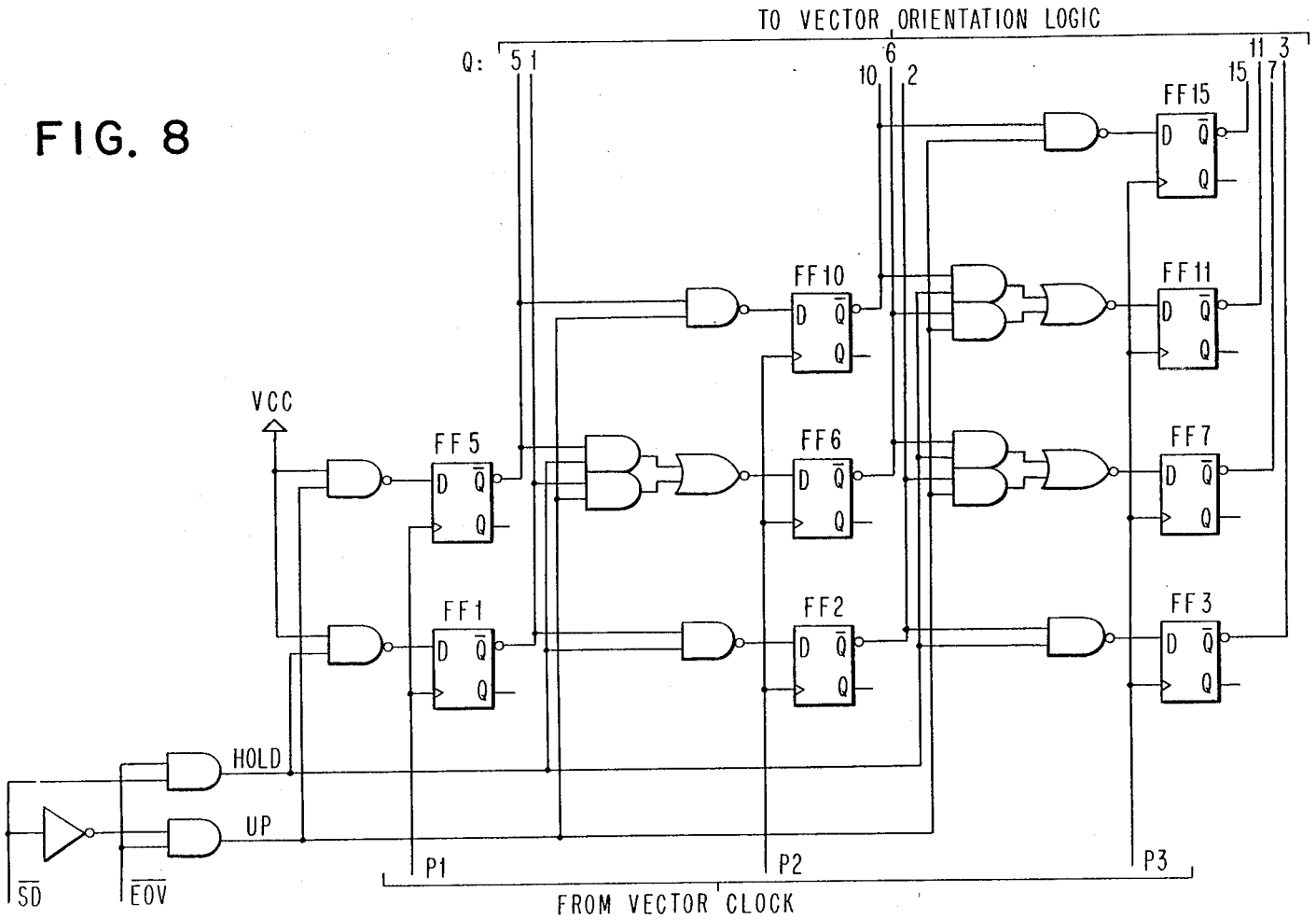
FIG. 8 comprises a detailed logic diagram of the vector generating circuitry.

The vector matrix shown in FIG. 8 is an intermediate register capable of representing any vector shape in the first octant. As may be seen by examining FIGS. 3A–3D, just nine flip-flop registers are required for that purpose. The bolt line is a boundary of all possible pixels, which can be used by a first octant vector (A). Pixels 4, 8, 9, 12, 13 and 14 can never be drawn, and the pixel 0 is always drawn and does not have to be specially remembered or stored.

The vector matrix, consequently, consists of three separate registers, a two bit register representing pixels 1 and 5, a three bit register representing pixels 2, 6 and 10, and a four bit register storing pixels 3, 7, 11 and 15.

The drawing of a 4 pixel vector segment utilizes the three VCLK cycles ($P_1$, $P_2$, $P_3$).

On the first cycle, a logical "1" representing the pixel number 0, is written into the flip-flop 1 or 5, depending on the SD signal. If the SD signal is equal to "0", i.e., the decision variable is positive and the y-coordinate should not be incremented, flip-flop 1 is set, and flip-flop 5 is reset. If the SD signal is 1, i.e., the decision variable is negative and the y-coordinate should be incremented, flip-flops 1 and 5 take opposite values.

On the second cycle, the data in flip-flops 1 and 5 is transferred directly to the flip-flops 2 and 6, and flip-flop 10 is reset, if the SD signal is equal to zero, or if the SD signal is equal to one, the data in flip-flops 1 and 5 is shifted into flip-flops 6 and 10 correspondingly, and flip-flop 2 is reset. In other words, data in the first register is loaded into the second register with or without the shifting up, depending on the SD signal.

On the third cycle, data in flip-flops 2, 6 and 10 is transferred with or without shifting up into the third register of flip-flops 3, 7, 11 and 15. Thus, by the end of the third VCLK cycle, the vector segment is represented by the vector matrix flip-flops, which are set to a "1" state.

Figure 2:
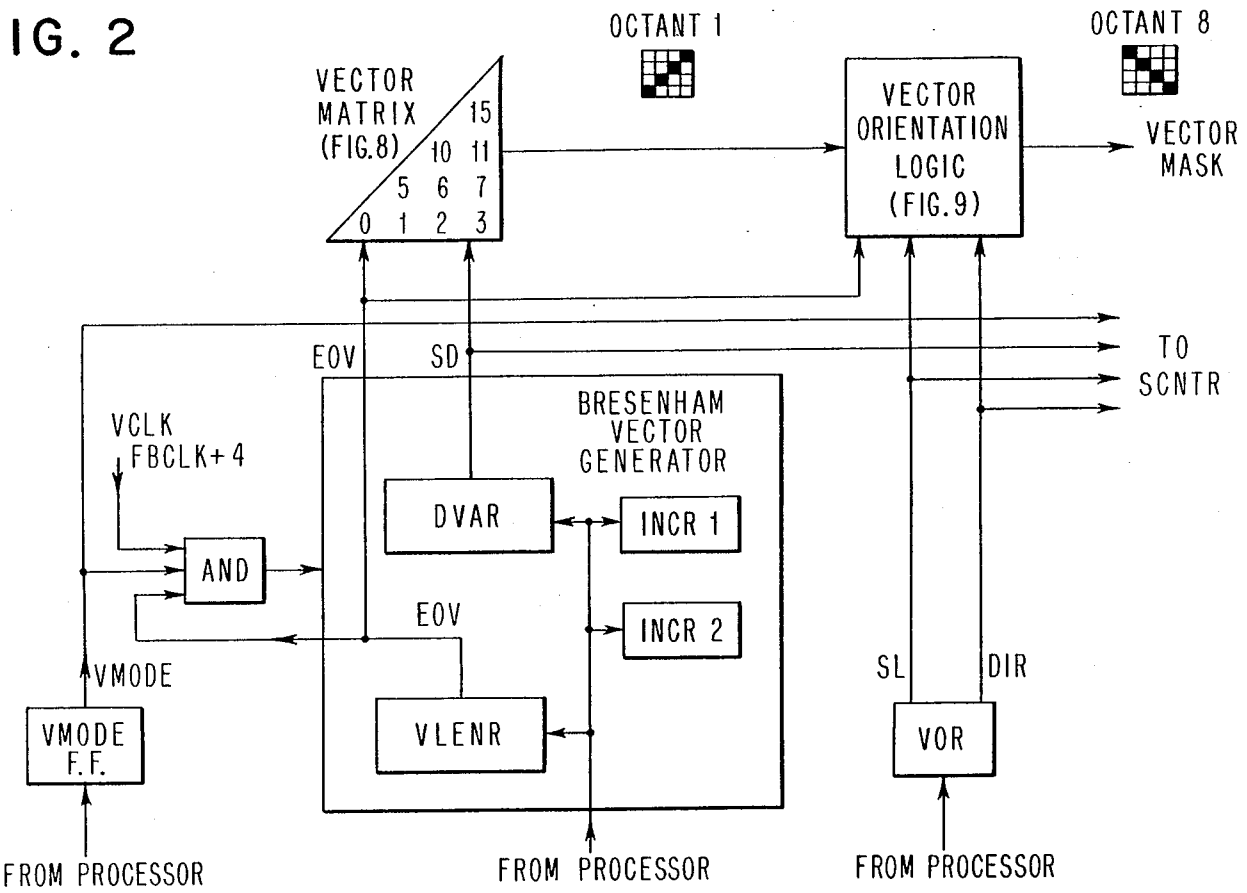
FIG. 2 comprises a functional block diagram of a vector generator architecture embodying the principles of the present invention.
Figure 3A:
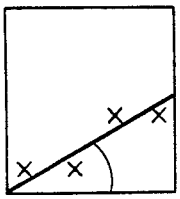
Figure 3B:
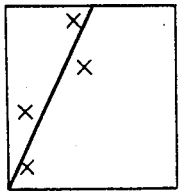
Figure 3C:
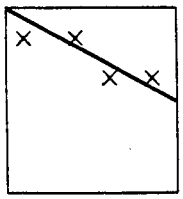
Figure 3D:
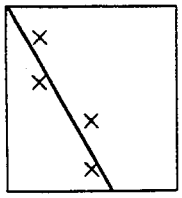
Figure 9:
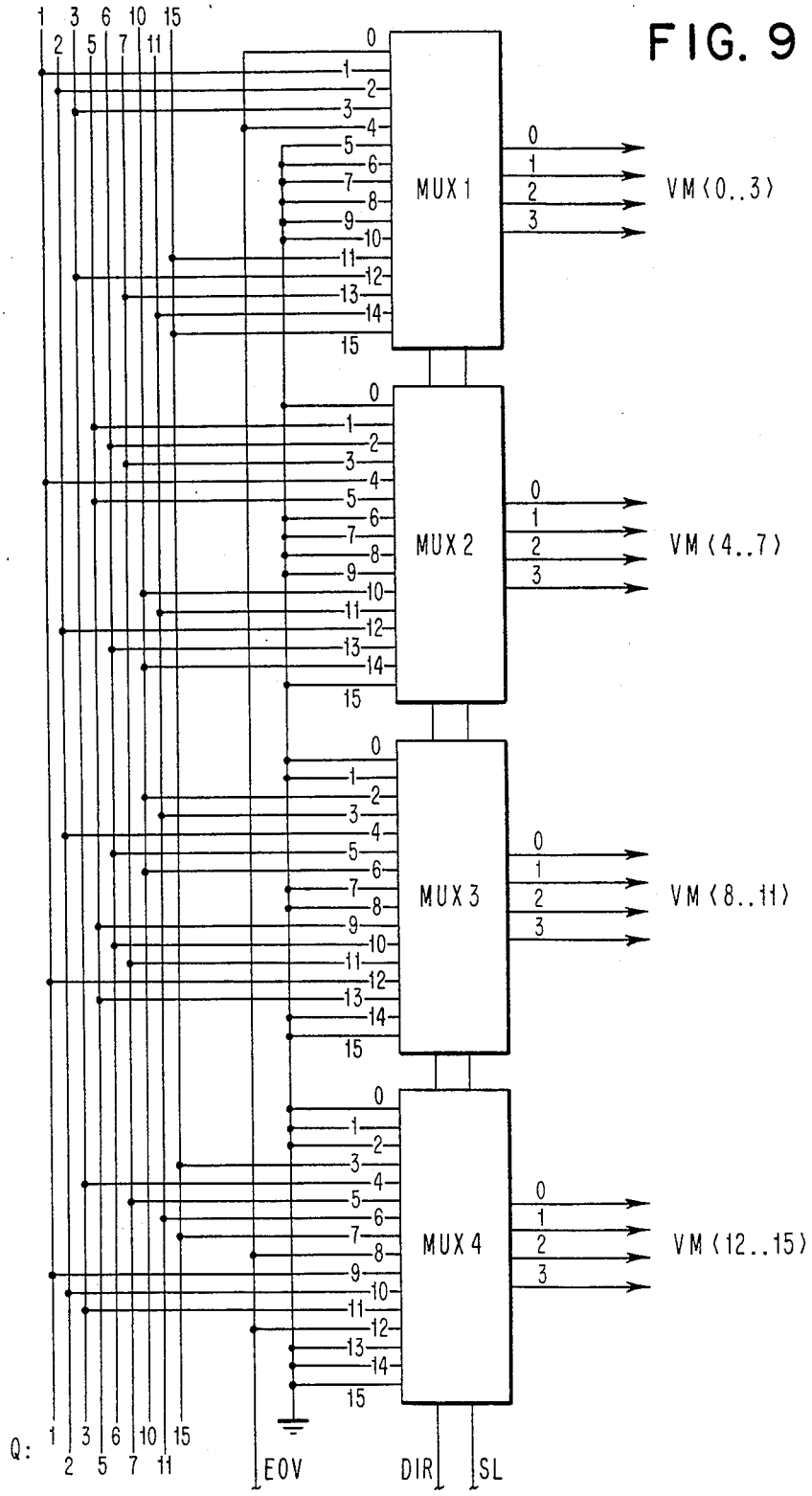
FIG. 9 comprises a block diagram of the vector orientation logic.

Based on the SL and DIR control bits value, the combinatorial vector orientation logic shown in FIG. 9 performs a transformation operation on the first octant vector shape providing no transformation (FIG. 3A), transformation into the second octant using the operation of transposition T( FIG. 3B), mirror transformation M (FIG. 3C) into the octant 8, or the combination MT of both operations M and T (FIG. 3D), transforming vector into the octant 7. The input and output codes of the vector orientation logic are the two small 4 by 4 matrix diagrams shown in FIG. 2, representing a vector positioned in the octant 8 by an MT transformation.

In FIGS. 3A–3D in the column labeled "Bit locations before and after transformation ops", the bit locations in the illustrated square 4 by 4 matrix are specified to show their mapping as they would exit from the vector orientation logic. As will be appreciated the bits of the vector matrix of FIG. 2 (1, 5, 2, 6, 10, 3, 7, 11 and 15) are representative of the numbered bits of FIGS. 3A–3D and the flip-flops of the vector matrix store the binary vector representation as they are generated, i.e., bits 0, 1, 6 and 7 would be set to a "1" for the example of FIG. 3A. The 0 bit is always considered set to a "1" and is accomplished by internal wiring within the vector orientation logic.

As will be appreciated all possible vectors including 45°, horizontal and vertical vectors may be drawn in this fashion by actuating the proper bits in the vector logic matrix and performing the suitable transformation in the vector orientation logic. Thus, for a positive slope 45° vector bits 0, 5, 10 and 15 would be set to a "1" with a DIR and SL value of (0,0). For a negative slope the same bits would be active but the DIR and SL bits would be (1,1) e.g., the vector transformation illustrated in FIG. 2.

However, the output of the vector orientation logic cannot be used as a write enable mask for the APA frame buffer, because it must be double shifted on the X and Y axes, according to the two least significant bits of X and Y address coordinates XAD<1 . . . 0> and YAD<1 . . . 0>. This operation is done by a write mask generator, illustrated in FIG. 4. It will of course be apparent that if the X, Y low order address coordinates are zero there will be no shift, as is the case if the array access in the frame buffer is exactly along a word boundary.

The write mask for the APA frame buffer includes a register, which may be called the Direct Mask Register (DMR), and an APA data alignment unit as described in the article by Sproull, R. F., Sutherland, I. E. Thompson, A., Gupta, S., and Minter C., "The 8×8 Display", Technical Report, Carnegie-Mellon University, Computer Science Department, 1981 pages 10 and 11. A Direct Mask Register for an APA frame buffer architecture is also shown in previously referenced copending application Serial No. (YO986-105). The Direct Mask Register allows writing any pattern into the frame buffer, e.g., text. The APA data alignment unit aligns mask data and is built according to known technique from eight 4-bit barrel shifters, as shown in previously referenced application Ser. No. 7/013,843 (Docket No. YO9-86-105).

The implementation described here requires just a small modification of that structure, adding a Vector Mask Register (VMR) and multiplexor MUX for switching VMR and DMR data, depending on whether a vector drawing or conventional bit-blt operation is being performed.

Figure 4:
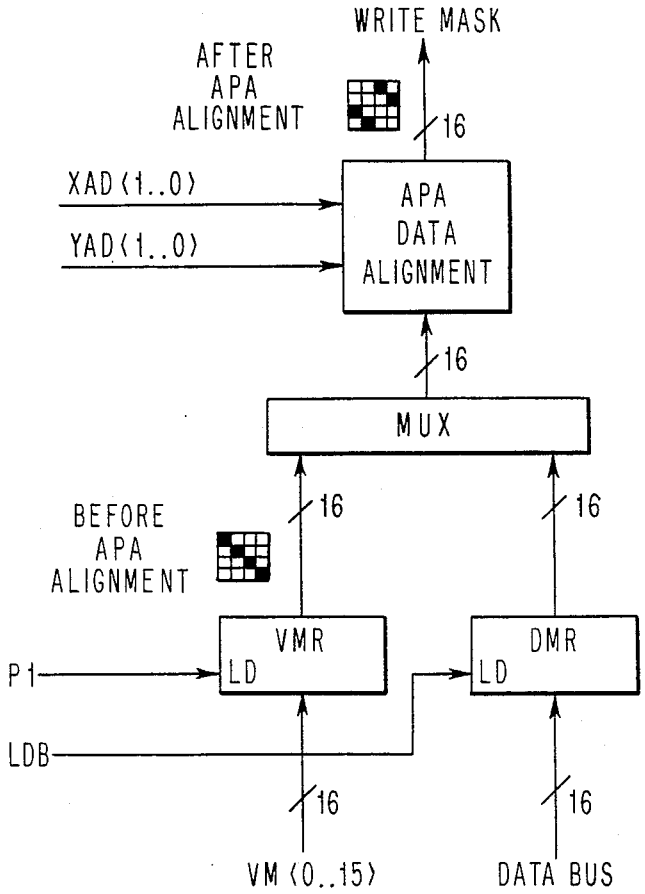
FIG. 4 comprises a functional block diagram of a write mask generator suitable for use with the present invention.

The output of the vector orientation logic VM<0 . . . 15> is loaded into the Vector Mask Register (VMR) at the end of the fourth (and last) clock period in the particular memory update cycle VCLK period (pulse P1). An example of a two position shift is shown in FIG. 4 by the two 4 by 4 pixel matrices, which represent a vector segment before alignment and after two bit shifting in both horizontal and vertical direction.

In order to have the frame buffer address updated for the next memory cycle, the bit-blt address control register's data must be changed at the end of each memory cycle. The SD, DIR and SL signals define bit-blt control data modification.

Depending on the vector slope, one of the X or Y coordinates may play the role of an independent coordinate. This means, that the independent coordinate of a 4 by 4 square array accessed during a frame buffer update cycle should be incremented by four at the end of each memory cycle. In other words, if the signal SL=0, i.e., $|Xend-Xst|>|Yend-Yst|$ then X is the independent variable, and conversely if the signal SL=1, i.e., $|Yend-Yst|>|Xend-Xst|$ then Y is the independent variable.

The direction defines whether the Y coordinate should be incremented or decremented. The X coordiante is always incremented, although just how it is done is a matter of implementation. Alternatively, it could always be decremented as will be apparent to those skilled in the art. This means that vector can be drawn only from left to right. This is not a real disadvantage, because any vector still can be drawn. It is often necessary to utilize such a discipline of drawing, because if a vector is to be erased, it is actually redrawn in the same direction, but using the background color. If an attempt were made to erase a vector in the opposite direction, there is no guarantee that all points would be erased (referred to as the "measles" effect).

The number of cases when a sign of the decision variable SD is negative during vector segment drawing indicates how the dependent coordinate should be changed at the end of the frame buffer update cycle.

Figure 10:
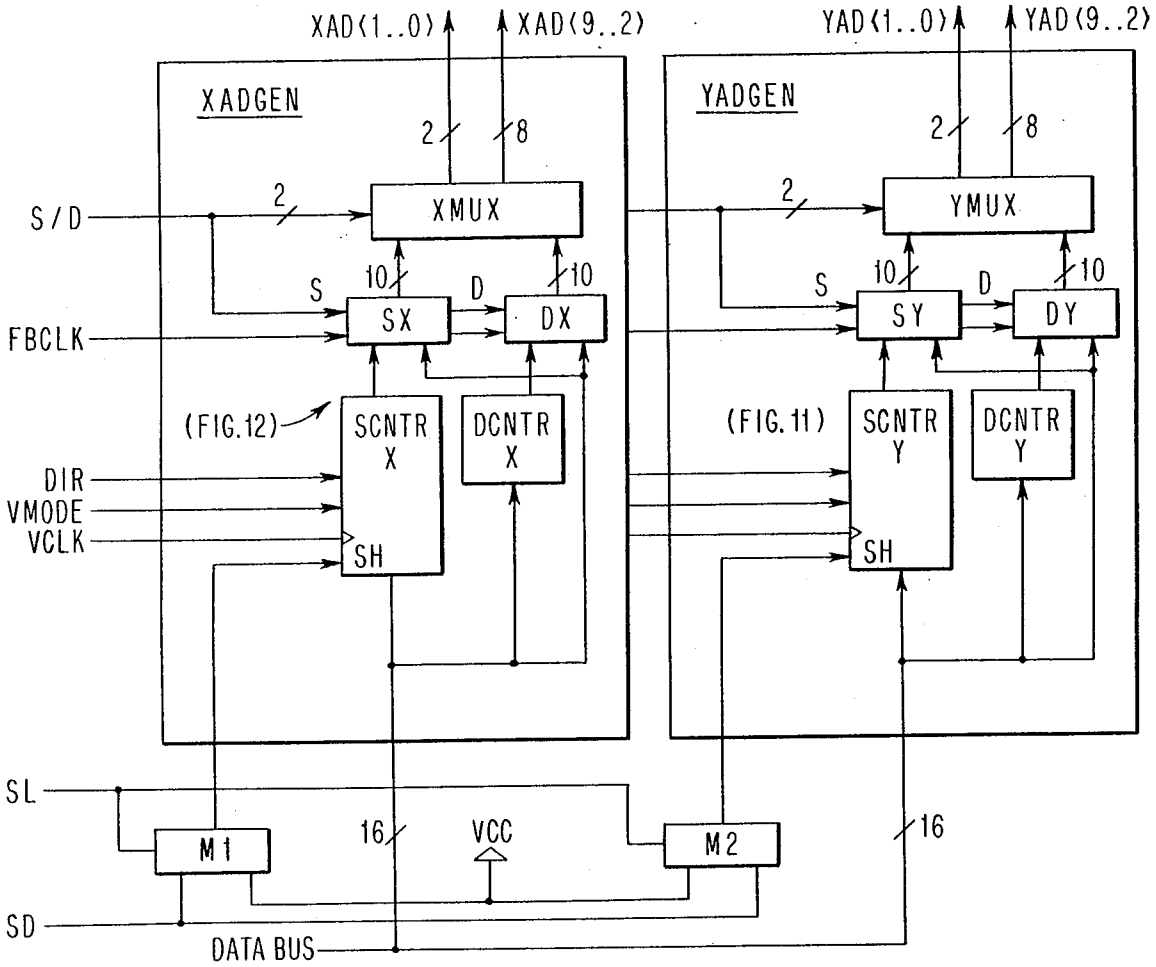
FIG. 10 comprises a functional block diagram of the bit-blt address controls.
Figure 11:
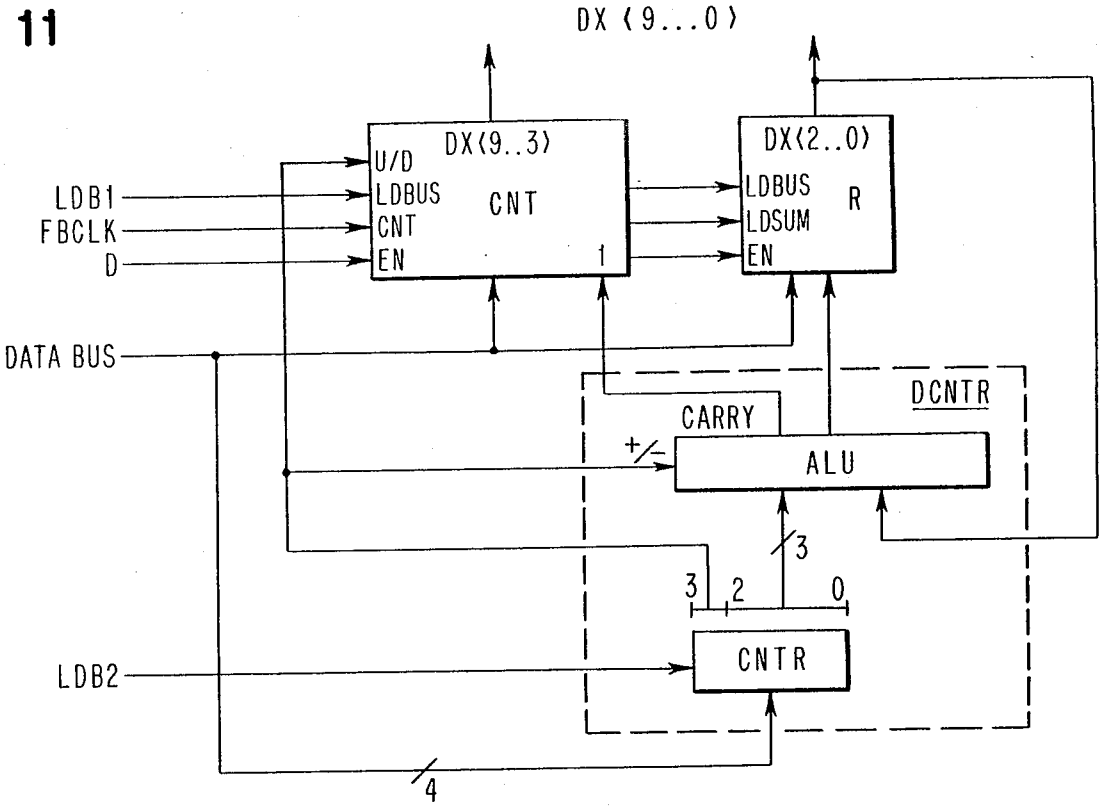
FIG. 11 comprises a functional block diagram of the destination X address control.
Figure 12:
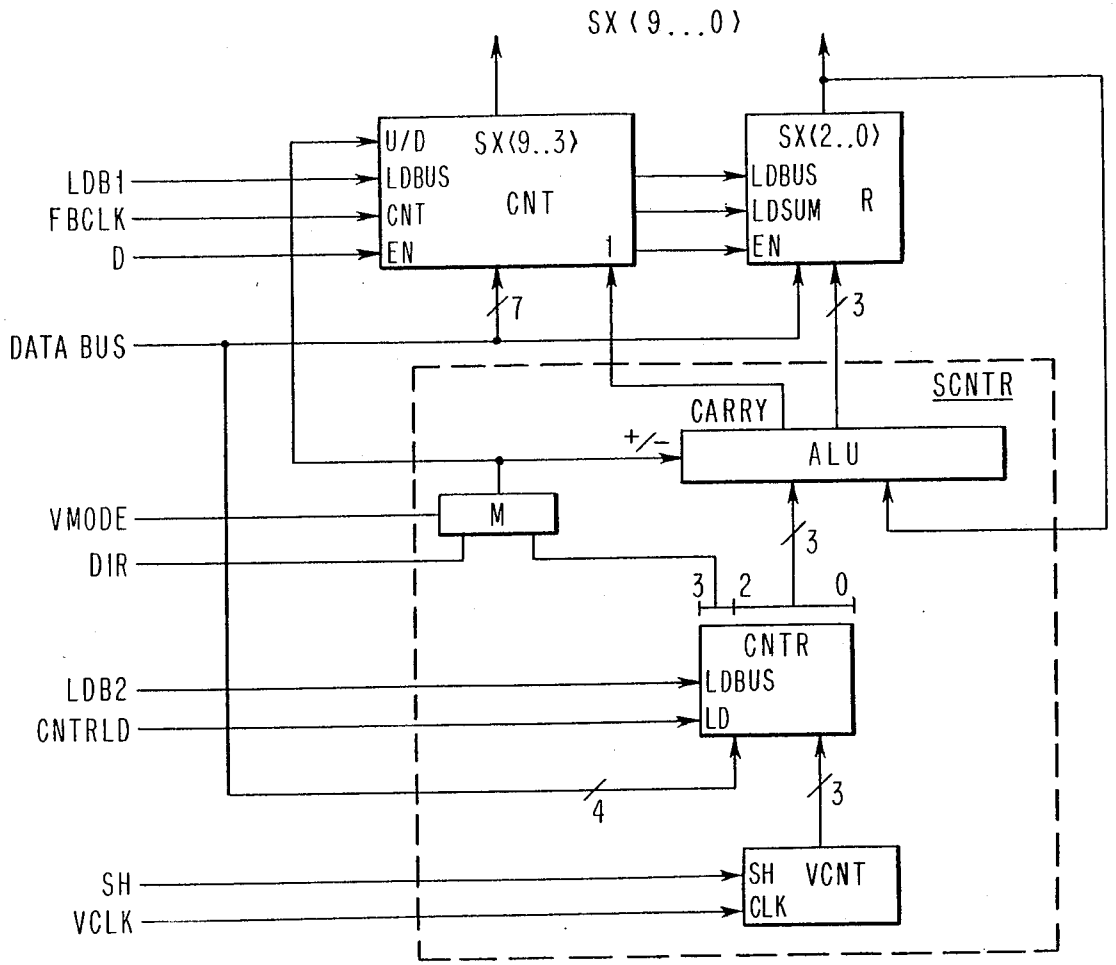
FIG. 12 comprises a functional block diagram of the source X address control.

A three bit counter (VCNT on FIG. 12) using VCLK as clock source and the SD signal as a count enable signal gives such a number at the end of the fourth VCLK period. This counter data is added or subtracted from the data in the bitblt control registers, as shown in FIGS. 10, 11 and 12 taking care of dependent coordinate modification.

Unfortunately, the first memory update cycle is idle, because the write mask is not ready yet. Therefore, before vector drawing starts, the VMR register must be cleared, disabling the frame buffer update.

The Xth address is not changed during the first memory update cycle. The Y address must be decremented by four, if the direction of drawing is negative (because the vector segment is drawn below the starting coordinate), and unchanged, if the direction is positive. The behavior of the address registers during the first memory update cycle is provided by the requisite loading of the bit-blt control registers, SX, DX and SY, DY from the host processor during the vector drawing set-up procedure.

The memory update cycles continue until the signal EOV becomes true, i.e., the end of vector is reached. It disables the VCLK clock pulse to the Bresenham vector generator, via the AND gate shown in FIG. 2. If the EOV signal becomes true at the middle of the frame buffer update cycle, the vector matrix registers, which would normally be updated next, are cleared instead. The last square update cycle then takes place. Thus, the vector generator draws four pixels of a vector segment, in the disclosed 4×4 array but drawing is stopped with an accuracy of one pixel.

The performance, timewise, of the vector generator described herein, may be defined as the frame buffer memory update cycle, divided by the dimension (number of pixels on a side) of the square access array. For example, if the memory cycle is 200 ns, and the access is provided by 8 by 8 square, the drawing performance is 25 ns per pixel in any direction.

There is, of course, an overhead, connected with the loading of control and address registers by the host processor, but the overhead is the same if vectors were drawn pixel wise, using a conventional vector generator. The first idle memory cycle may be neglected in performance calculation, especially for longer vectors.

The following describes the use of the herein described vector generator in an overall video adapter provided with the frame buffer architecture set forth and described in previously referenced application Serial No. (YO986-105).

Figure 5:
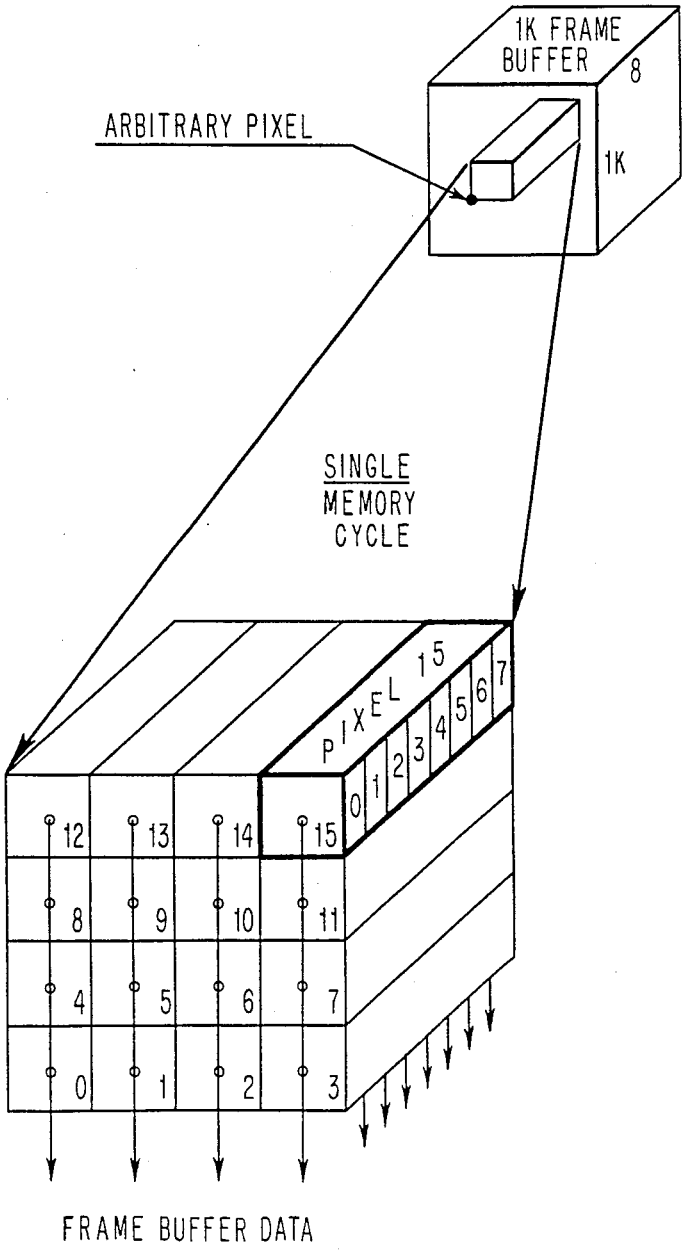
FIG. 5 is a diagrammatic view illustrating an all-points-addressable frame buffer suitable for use with the present invention, which provides 4 by 4 pixel access array in essentially a single memory access cycle.

The frame buffer capacity is not critical, however, to utilize the present vector generator architecture, a good practical embodiment would require, a frame buffer with 4 by 4 square access. It should be noted that the easiest way of providing such an array access with a minimum number of memory chips and practical image resolution is guaranteed by a frame buffer 1K by 1K (FIG. 5). The figure illustrates the numbering utilized to identify the 16 pixels accessed in a frame buffer cycle. Each pixel is located in a different chip as will be apparent from the referenced copending application (YO986-105).

Figure 6:
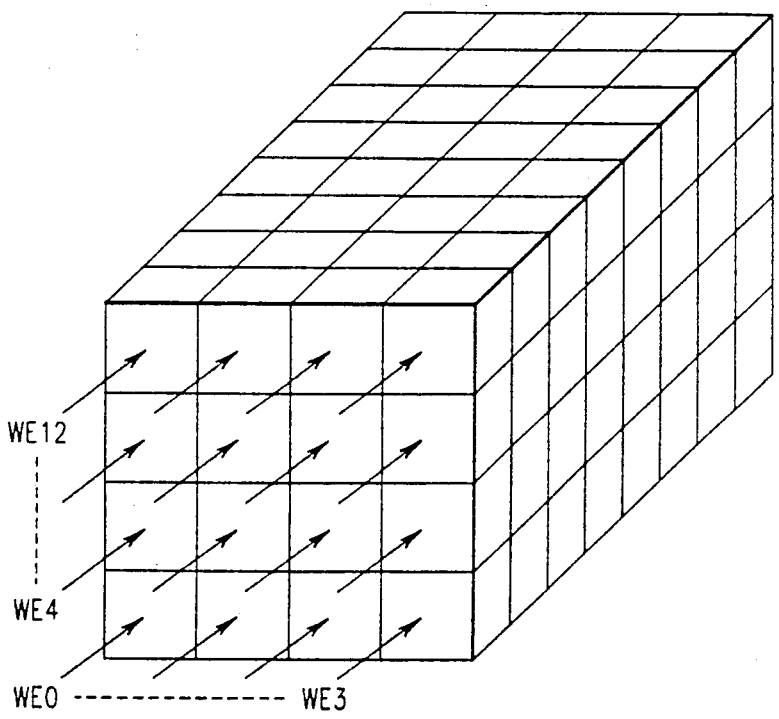
FIG. 6 comprises a diagram which illustrates the frame buffer masking mechanism.

Such a frame buffer requires sixteen 64K bit memory chips for one bit plane (FIG. 6). The number of planes, or bits per pixels, is not critical (8-bit per pixel or 128 chips are shown). Also, it is not necessary that all 16 pixels can be updated in one cycle (in general case vector color (or intensity) is constant), data I/O can be connected at least in one direction, e.g., vertical.

All chips have common controls. The updating of all phases of the same pixel is controlled by sixteen separate write enable signals (WEO . . . WE15), which are shown in FIG. 6 by slanted vectors. Pattern of write enable signals is controlled by a "write mask" register previously and would be included in the frame buffer controlling hardware.

Figure 7:
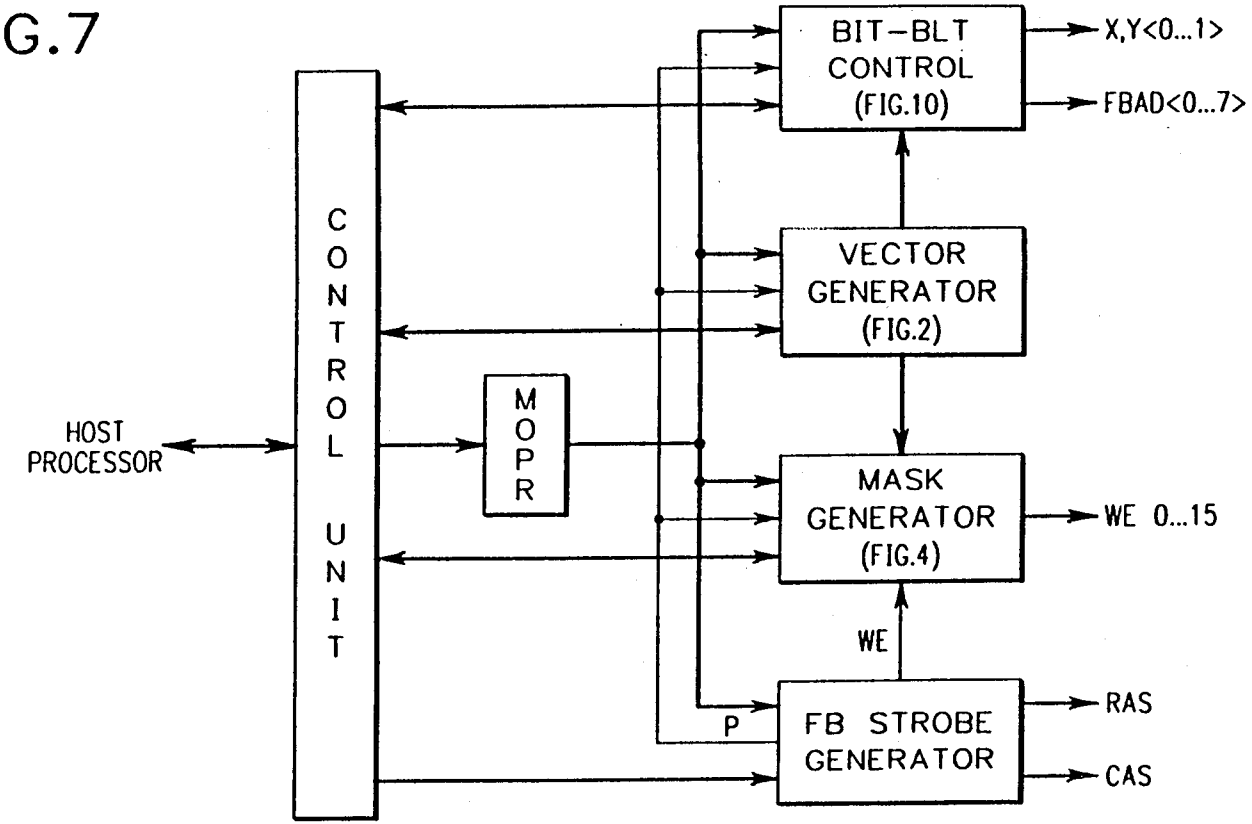
FIG. 7 comprises a functional block diagram of the overall frame buffer controlling hardware organization illustrating how the bit-blt controls of FIG. 10, the vector generator of FIG. 2, and the mask generator of FIG. 4 are organized within the overall system.

The hardware which controls the frame buffer updating is shown in FIG. 7 and consists of a control unit, memory operation register (MOPR), bit-blt control block, vector generator, mask generator and frame buffer strobe generator.

The control unit assists the host processor in loading address and control registers. The frame buffer strobe generator provides sync pulses P, frame buffer row address (RAS) and column address (CAS) strobes and the write enable signal WE. The mask generator provides the write mask and applies it to the WE signal, to produce the WEO . . . WE15 frame buffer write signals. The bit-blt control unit supplies the frame buffer with addresses, decrementing or incrementing one or both X or Y addresses at the end of each memory cycle. The vector generator modifies the write mask and bit-blt control parameters as required. The MOPR when loaded with a suitable memory operation opcode (e.g., "write", "read" etc.) starts consecutive memory cycles, allowing sync pulses P to activate the necessary operations as is well understood in the art.

The vector generator, as set forth in the previous description of the disclosed embodiment, includes three major parts: a conventioal Bresenham vector generator (which does not need to be discussed further, as such vector generators are well known in the art as set forth previously, a vector matrix unit and the vector orientation logic.

The vector matrix shown in FIG. 8 was described previously and includes nine D-type flip-flops and intermediate NAND, AND and NOR gates, which allow the shift of the data to the right and up at the same time. The signals SD and EOV control the data shift in the vertical direction. Depending on the polarity of the SD signal one of two lines "HOLD" or "UP" is activated. The EOV signal, when activated, makes both lines inactive, disabling shift up. Pulses P1, P2 and P3 represent the first, second and third period of the VCLK in one frame buffer memory access cycle and control horizontal data shift. A logical "one" on the outputs Q1, Q5, etc., enable corresponding pixels for the write update operation.

The vector orientation logic (FIG. 9) consists of the four 16 to 4 bit multiplexors MUX1 . . . MUX4. The inputs to these multiplexors are connected to the outputs of the vector matrix circuit and a ground signal in such a way that the transformation, described previously, occurs under the control of the DIR and SL signals. The multiplexors' outputs represent the vector mask VM0 . . . VM15. The EOV signal, when negated, also negates VM0 or VM12, because the pixel 0 (when direction is positive) or pixel 12 (when direction is negative) is always, enabled and is not represented by a flip-flop in the vector matrix as one of the pixels would always be present as the origin of the vector.

The bit-blt address control (FIG. 10) includes two identical frame buffer address generators: XADGEN for horizontal address control and YADGEN for vertical address controls. Each address generator provides a 10 bit address, the two least significant bits (1,0) of which are used for mask alignment and eight most significant bits (9 . . . 2) which are used for the addressing of the memory chips (after combining them further into one 8-bit address under the RAS and CAS strobes timing control.

The bit-blt operations usually require a minimum two pairs of address registers for addressing source and destination areas on the screen; source address registers SX and SY, and destination address registers DX and DY. Any memory cycle uses one and only one set of those registers (S or D), selected by two S/D (source/destination) control bits derived from the MOPR register. Those bits control multiplexors XMUX and YMUX and enable changes of the used address registers' content at the end of the frame buffer cycle (FBCLK) period).

The address register may be incremented or decremented or hold, based on data in the corresponding control blocks SCNTR X, DCNTR X, SCNTR Y and DCNTR Y. All address and control registers in the control blocks may be also loaded by the host processor.

For conventional bit-blt operations (clear, copy or combination) the control blocks may be conventional. However, for the vector generator architecture of the present invention, a modification of one pair of control blocks is required, e.g., the SCNTR blocks.

The implementation of the bit-blt address control required by the present invention may be as shown in FIG. 11, where the destination X address control hardware is shown. It includes seven bit up/down counter CNT, a three bit register R, arithmetic-logic unit ALU and a four bit control register CNTR.

The counter and register together comprise the DX register of FIG. 10. The counter provides the 7 most significant bits (9 . . . 3) of the destination X address and the register provides the three least significant bits (2 . . . 0).

The host processor data may load the destination X address from the DATA BUS to both the counter and register by 'load data bus' LDB1 signal. The CNTR register may be also loaded from the DATA BUS by a corresponding load signal LDB2.

The clock FBCLK provides a content modification in both R and CNT devices at the end of the frame buffer update cycle. It clocks the counter CNT and loads the output of the ALU into the register R. The signal D enables the end of cycle modification. The carry bit of the ALU controls the switching of the first bit of the counter. Accordingly, depending on the polarity of the carry and U/D (up/down) signals, the counter will be incremented or decremented by 1.

The ALU adds (subtracts) a number represented by the three least significant bits of the CNTR register to (from) the contents of register R. Bit 3 of the CNTR controls +/− operation code input (add or subtract) of the SUM and corresponding counter operation (increment or decrement). Consequently, DX content may be decremented or incremented by any number from 0 to 7 (practically, a limit of 4 is adequate but this requires a three bit representation in CNTR anyway).

The source address control hardware is different from conventional bit-blt controls in the way it provides for vector drawing in a multi-pixel array access in an APA frame buffer as shown in FIG. 12. It includes a two-to-one multiplexor M and three bit counter VCNT.

In a conventional bit-blt more the source address control is no different from destination address control. However, during vector drawing the mode signal VMODE, by means of multiplexor M, connects the DIR bit of the vector orientation register VOR (see FIG. 2) to the U/D control input of the CNT and to the +/− operation code input of the ALU. The CNTR content is reloaded in the middle of each memory update cycle from the VCNT, preparing for the change of the SX data by the beginning of the next consecutive memory cycle. The VCNT uses the VCLK signal as a clock. The counting of data is enabled by the SH signal. The SH signal may either always be active (in the case of the present SCNTR embodiment, it controls the independent coordinate) or be dependent on the SD signal from the vector generator (see FIG. 2). FIG. 10 shows that the SL bit from the VOR register, by energizing one of two multiplexors M1 and M2 either connects the SD signal to the SH input of the SCNTR X block and VCC (unconditionally enabling signal) to the SCNTR Y or vice versa.

Figure 13:
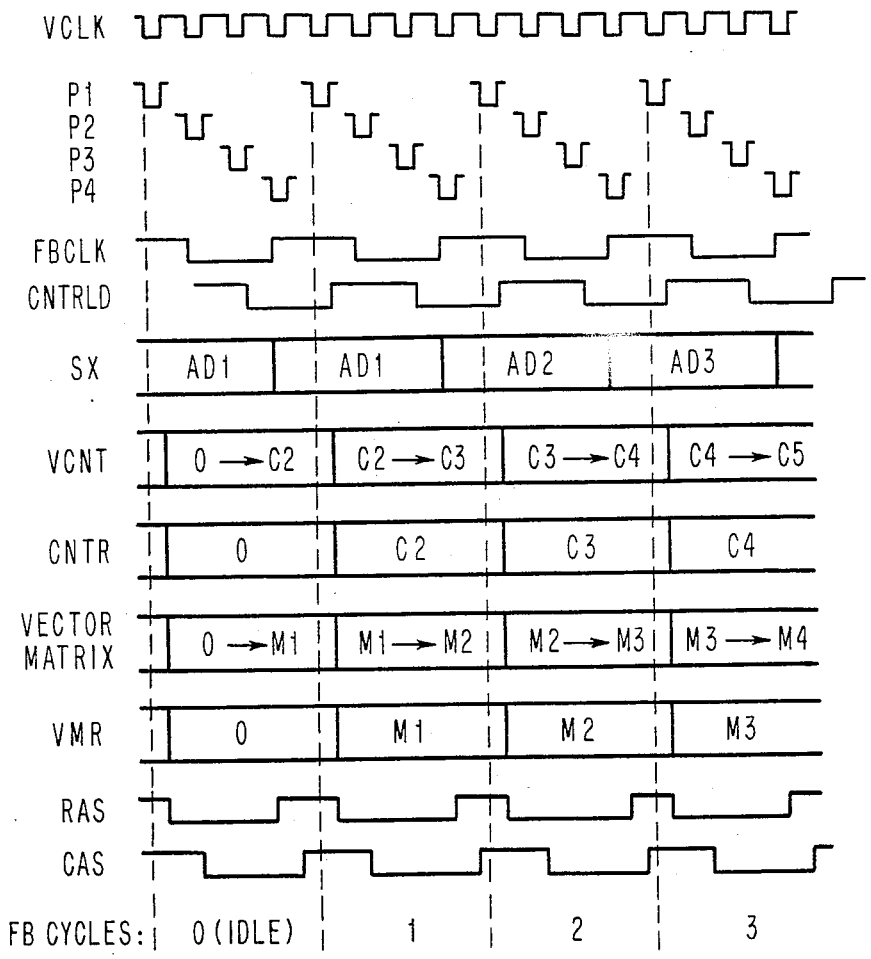
FIG. 13 comprises a set of timing diagrams for a typical vector drawing operation.

The vector drawing timing diagram (FIG. 13) shows all of the necessary sync signals and the contents of the main registers for the source X coordinate control during the sequential drawing of four pixel vector segments.

Four separate pulses P1, P2, P3 and P4 are derived from VCLK sequence synchronously with the FBCLK and CNTRLD sequences. FBCLK and CNTRLD have different phases. All actions are performed by the rising edges of the pulses.

Before the drawing starts, the vector starting pixel coordinate AD1 is loaded into the SX address register. The VCNT, CNTR, vector matrix, and VMR are all reset.

During the first frame buffer update cycle (FB cycle 0) the APA vector generator starts drawing of the first segment of the vector, preparing a vector mask M1. VCNT keeps changing to a number C2, representing an increment of the X coordinate for the FB cycle 2. Memory strobes RAS and CAS, although active, do not cause the frame buffer update, for the VMR content is zero.

In the beginning of the FB cycle 2 the SX register still keeps ADO data, because the CNTR data was zero in the FB cycle 0 at the FBCLK rising edge. The CNTLD pulse loads C2 data from VCNT to the CNTR and vector matrix data M1 into the VMR register. Accordingly, the RAS and CAS strobes cause the first real update of the frame buffer at the address AD1 using write mask M1. And at the end of the cycle address AD2 is substituted for AD1 in the SX register under control of C2 data in the CNTR register.

The remaining frame buffer cycles are identical until an end of vector (EOV signal) is produced. If frame buffer refresh or video refresh is being performed, it is done on a cycle stealing basis (refresh cycles are not shown in FIG. 13).

The source Y coordinate is controlled in an identical fashion. The only difference is that if the direction of drawing is negative, the set-up data in the three least significant bits of the CNTR Y register must be 4, not 0.

Having thus described our invention, what we claim as new and desire to secure by Letters Patent is:

1. In a video adapter including a pixel processor for performing selected video data operations and for supplying video data to an all-points-addressable frame buffer capable of accessing a pixel aligned M by M square array of multi-bit pixels (on the screen) during a single memory cycle and bus means connecting the adapter to a host processor and the frame buffer to a raster scan display monitor, the improvement which comprises;

a vector generator architecture in said pixel processor which produces M vector bits per clock cycle of the frame buffer said generator including, a vector clock which produces a clock rate of M times the frame buffer clock rate in a particular cycle, an arithmetic line generator which produces a binary Y axis (vertical) increment signal (SD) in response to each pulse the vector clock produces up to M−1 pulses per frame buffer clock cycle in accordance with vector defining coordinates provided to the line generator together with a vector length signal by the host processor, a vector matrix logic circuit for generating and storing the bits of a vector to be subsequently stored in said frame buffer as a function of the output of said line generator Y increment bits and successive X increment signals from said vector clock, said matrix containing as many storage elements as there are pixels in the lower triangular matrix of the M by M square array of pixels on the screen, accessible from the frame buffer in a single memory cycle wherein any vector displayable by said M by M pixel square matrix may be represented by a vector generated in said bit matrix, the displayed vector being a function of four possible matrix transformation operators supplied to a vector orientation logic circuit comprising (1) no change, (2) transposition, (3) mirroring and (4) mirroring plus transposition which will produce a vector of every possible slope and direction representable in the M by M square matrix, and said vector orientation logic circuit for producing a true vector mask having as one set of binary inputs the storage elements of said vector matrix and a second set of binary input signals representing the actual slope and direction of the vector to be generated whereby a true binary representation of the properly oriented vector as it should appear on the screen is produced.

2. A vector generator architecture as set forth in claim 1 wherein said vector orientation logic includes;

means for mapping the vector bits stored in said vector matrix into a specific organization selectively representing tte vector to be stored in the frame buffe in one of four possible transformations.

3. A vector generator architecture as set forth in claim 2 wherein said vector orientation logic circuit includes;

M multiplexors each having $M^2$ binary inputs (representing all possible pixels of the M by M square array on the screen of the monitor) and M outputs, representing a row of column of pixels on the screen, control means in each of said multiplexor for selecting a particular set of inputs to the multiplexor in accordance with slope (SL) and (direction) binary signals which specify one of four possible transformations of the vector generated and stored in the vector matrix selected comprising (1) no change (2) transposition (3) mirroring or (4) transposition and mirroring, the outputs of all of said M multiplexors comprising a true representation of the generated vector.

4. A vector generator architecture as set forth in claim 2 wherein said line generator includes;

means for generating an end of vector (EOV) signal when it is determined that the last pixel of the vector has been produced and means responsive to same to inhibit the generation and storage of any further vector pixel bits in what remains of a current vector generation clock cycle.

5. In a video adapter including a pixel processor for performing selected video data operations and for supplying video data to an all-points-addressable frame buffer capable of accessing a pixel aligned M by M square array of multi-bit pixels (on the screen) during a single memory cycle and bus means connecting the adapter to a host processor and the frame buffer to a raster scan display monitor, the improvement in the overall pixel processor architecture comprising;

an adapter control unit for interfacing with an attached host processor for processing instructions and data for the adapter, bit-blt unit connected to the adapter control unit, the frame buffer and a vector generator unit, said bit-blt unit including address means for selectively generating and storing addresses for successive bit-blt access operations or vector generation operations in said frame buffer, said vector generator unit being connected to said adapter control unit, said bit-blt control unit and a mask generator unit which produces M vector bits per clock cycle of the frame buffer, said mask generator unit for generating a direct M by M write enabling pixel mask array from the output of vector data from said vector generator unit and address data from said bit-blt unit whereby proper alignment of the generated vector in the frame buffer will be automatically assured, and a frame buffer strobe generating unit connected to the adapter control unit and the other three units including timing circuit means for producing a basic frame buffer clock sequence, a frame buffer "write enable" pulse and row and column address strobes for sequentially enabling M row and M column address strobe lines in said frame buffer whereby said M by M square array of pixels (on the screen) may be accessed in said frame buffer.

6. A pixel processor architecture as set forth in claim 5 wherein the mask generator unit includes;

means for creating a direct write mask including means for storing the square M by M bit vector mask from the vector orientation logic circuit and selectively rotating said mask around the X and/or Y axes as a function of the low order X and Y address bits of the origin address of the M by M array to be accessed from the frame buffer, wherein said low order X and Y address bits are zero if the origin is exactly on a physical word boundary.

7. A pixel processor architecture as set forth in claim 6 wherein the bit-blt unit includes;

means for incremeting one of either the X or Y bit-blt address registers as a function of the (X or Y intercept of the) dependent variable of the vector generation process and means for incrementing the other address register as a function of the independent variable from a vector generation clock which has a frequency of M times the frame buffer memory clock.

8. A pixel processor as set forth in claim 7 wherein the means for incrementing includes;

a counter associated with both the X and Y address registers for counting the number of times the independent and dependent variables are incremented during the vector generation process and means for adding the count contained ins aid counters to the previous address in the X and Y address register respectively at the end of each vector generation cycle and means for utilizing these addresses as the origin address for the next vector to be generated and stored in the frame buffer.

9. A pixel processor architecture as set forth in claim 5 wherein the vector generator unit includes;

a vector clock which produces a clock rate of M times the frame buffer clock rate, an arithmetic line generator which produces a binary Y axis (vertical) increment signal (SD) in response to each pulse the vector clock produces up to $M-1$ pulses per frame buffer clock cycle in accordance with vector defining coordinates provided to the line generator together with an end of vector (EOV) coordinate, by the host processor, a vector matrix logic circuit for generating and storing the bits of a vector to the subsequently stored in said frame buffer as a function of the output of said line generator Y increment bits and successive X increment signals from said vector clock, said matrix containing as many storage elements as there are pixels in the lower triangular matrix of the M by M square array of pixels on the screen, accessible from the frame buffer in a single memory cycle wherein any vector displayable by said M by M pixel square matrix may be represented by a vector generated in said bit matrix, the displayed vector being a function of four possible matrix transformation operators supplied to a vector orientation logic circuit comprising (1) no change, (2) transposition, (3) mirroring and (4) mirroring plus transposition which will produce a vector of every possible slope and direction representable in the M by M square matrix, and said vector orientation logic circuit for producing a true vector mask having as one set of binary inputs the storage elements of said vector matrix and a second set of binary input signals representing the actual slope and direction of the vector to be generated whereby a true binary representation of the properly oriented vector as it should appear on the screen is produced.

10. A vector generator architecture as set forth in claim 9 wherein said vector orientation logic includes;

means for mapping the vector bits stored in said vector matrix into a specific organization selectively representing the vector to be stored in the frame buffer in one of four possible transformations.

11. A vector generator architecture as set forth in claim 10 wherein said means for mapping comprises;

M multiplexors each having $M^2$ binary inputs representing all possible pixel locations of the M by M square array on the screen of the monitor and M outputs, representing a row or column of pixels on the screen, control means in each said multiplexor for selecting a particular set of inputs to the multiplexor in accordance with slope (SL) and (direction) binary signals which specify one of four possible transformations of the vector generated and stored in the vector matrix selected comprising (1) no change (2) transposition (3) mirroring or (4) transposition and mirroring, the outputs of all of said M multiplexor comprising a true representation of the generated vector.

12. A vector generator architecture as set forth in claim 11 including a line generator which further includes;

means for generating an end of vector (EOV) signal when it is determined that the last pixel of the vector has been produced and means responsive to same to inhibit the generation and storage of any further vector pixel bits in what remains of a current vector generation clock cycle.

* * * * *